US005746343A

United States Patent [19]

Waltke et al.

[11] Patent Number: 5,746,343

[45] Date of Patent: May 5, 1998

[54] FLEXIBLE BAG FOR LIQUIDS MOUNTED ON A FRAME

[75] Inventors: David L. Waltke; Gary L. Bouc, both of Beatrice, Nebr.

[73] Assignee: Hoover Group, Inc., Alpharetta, Ga.

[21] Appl. No.: 757,826

[22] Filed: Nov. 27, 1996

[51] Int. Cl.[6] ..... B65D 33/02

[52] U.S. Cl. ..... 220/9.2; 220/6; 220/401; 220/404; 220/4.28; 206/600

[58] Field of Search ..... 220/6, 1.5, 400, 220/401, 404, 9.3, 9.2, 9.1, 4.28; 206/386, 600

[56] References Cited

U.S. PATENT DOCUMENTS

| | | | |
|---|---|---|---|
| 3,035,682 | 5/1962 | Ferch | 220/9.2 |
| 3,372,725 | 3/1968 | Voorhees | 220/9.2 |
| 4,646,802 | 3/1987 | Basore | 220/9.3 |
| 4,795,350 | 1/1989 | Rubio | 220/9.2 |
| 5,056,667 | 10/1991 | Coogan | 206/600 |
| 5,100,026 | 3/1992 | Farrell . | |
| 5,437,384 | 8/1995 | Farrell | 220/404 |
| 5,622,277 | 4/1997 | Van Giezen et al. | 220/6 |

FOREIGN PATENT DOCUMENTS

| | | | |
|---|---|---|---|
| 2703981 | 10/1994 | France | 220/9.1 |
| 3301 600 | 7/1984 | Germany | 206/600 |
| 2 250 976 | 6/1992 | United Kingdom | 220/401 |
| 2297740 | 8/1996 | United Kingdom . | |

*Primary Examiner*—Stephen J. Castellano

*Attorney, Agent, or Firm*—Harness, Dickey & Pierce, P.L.C.

[57] ABSTRACT

A container assembly for transporting and storing liquids and semi-liquids, the container assembly including a rigid frame supporting a collapsible fabric bag which contains the liquid. The bag is hung at its upper end on tubes in the frame that are threaded through loops in the upper ends of the bag side walls. An elastically deformable support plate is in the frame for cushioning the shock of the bag during transport. The frame is collapsible to enable collapse of the bag after it is emptied.

4 Claims, 4 Drawing Sheets

FLEXIBLE BAG FOR LIQUIDS MOUNTED ON A FRAME

BACKGROUND AND SUMMARY OF THE INVENTION

This invention relates generally to container apparatus for bulk material and, more particularly, this invention relates to collapsible container apparatus for transporting and storing fluids, such as liquids, powders and granular materials. The container apparatus consists particularly of a flexible bag mounted on a metal frame, the bag being collapsible to discharge its contents.

In particular, this invention is an improvement on the container apparatus shown in U.S. Pat. No. 5,437,384. The present invention is patterned after the bag and frame assembly that constitutes the container in the above mentioned patent.

In the present container apparatus, the top of the frame includes four bag support tubes. Previous bags used a large number of pop-rivets and metal strips to hold up the bag. The bag tube support system in the present container allows the customer to quickly detach the bag from the frame for cleaning or repair.

In addition, the present container apparatus utilizes a lower support plate in conjunction with the bag tube support system to provide shock absorber action for the bag during transport of the container apparatus with the flexible bag full. This shock absorbing action functions to cushion the bag during up and down movement of the bag. The bag has four walls and at the upper ends of the walls integral fabric loops are formed which are mounted curtain rod fashion on the four bag support tubes.

According to this invention, there is provided container apparatus for transporting and storing fluid material, which container apparatus comprises a flexible bag, a rigid frame which supports the upper end of the flexible bag, the frame including a rigid base and elongated support members which are positioned outside the flexible bag, the support members being such that they are movable from a first position in which they extend between the rigid frame member and the rigid base to hold the rigid frame member firm with respect to the rigid base, to a second position where they allow the sides of the flexible bag to collapse by folding when the flexible bag does not contain the fluid material. The container apparatus is characterized in that the rigid frame member is provided with inboard portions which are inboard of the elongated support members and which are attached to the sides of the flexible bag thereby to draw the sides of the flexible bags essentially inboard of the rigid base.

Further objects, features and advantages of the invention will become apparent from a consideration of the following description and the appended claims when taken in connection with the accompanying drawings.

DETAILED DESCRIPTION OF THE PREFERRED EMBODIMENT

Figure 1:
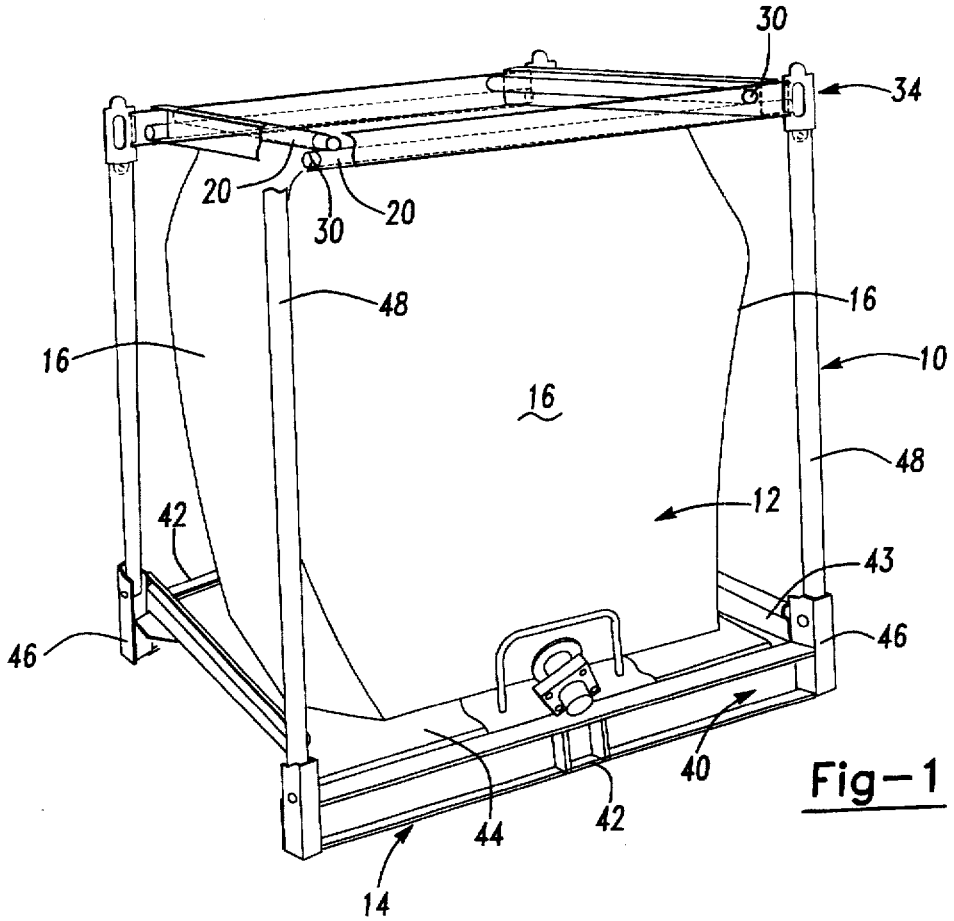
FIG. 1 is a perspective view of the container apparatus of this invention, showing the apparatus in its "transport and storage condition" in which the bag is filled with product.
Figure 2:
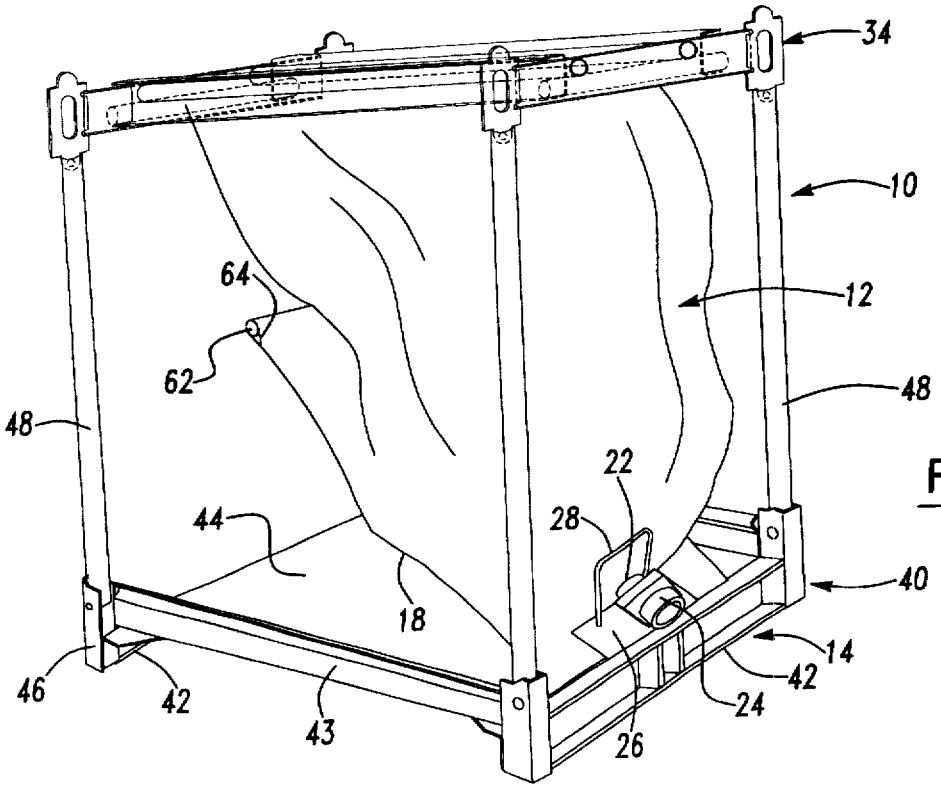
FIG. 2 is a perspective view of the container apparatus of this invention showing the bag being collapsed to discharge the contents through a discharge valve.

With reference to the drawing, the container apparatus of this invention, indicated generally at 10 in FIGS. 1 and 2, is shown as consisting essentially of a large flexible bag 12 and a supporting metal frame 14. The flexible bag 12 is made of a fabric material. Preferred fabrics are non-elastic woven fabric materials, such as polyester which is coated, for example, with polyvinyl chloride, to prevent ingress of dirt or fluid material into the interstices of the weave. The metal frame 14 is made of mild steel which is zinc plated or galvanized and can also be made of stainless steel.

The flexible bag 10 is substantially rectangular in cross section and is generally confined within the cubical confines of the frame 14. The bag 12 has four upright walls 16, a bottom member 18 and integral fabric loops or sleeves 20 at the upper ends of the side walls 16. The flexible bag has an opening 22 at its lower end and is provided with a discharge valve 24 supported on a member 26 which is secured to the frame 14. A valve guard 28 is secured to the frame.

At its upper end, the four side walls 16 of the flexible bag 12 are mounted on four straight tubes or pipes 30 (FIGS. 3 and 4) each of which is mounted on a pair of frame members 32 which form part of an upper generally rectangular sub-frame 34. The frame members 32 are formed with openings 36 of a size to slidably receive a pipe 30. Each tube 30 is longer than the distance between the frame members 32 on which it is mounted. Consequently, each tube extends beyond the frame members 32 at its ends. Conventional hair clips 38, only one of which is shown, are then inserted through the end portions of the tube 30 so as to prevent lengthwise movement of the tube 30 on the frame members. The tubes 30 define a rectangular shape inlet or fill opening 31 (FIG. 1) for the bag 12.

When the flexible bag 12 is to be mounted on the frame 10, the four tubes 30 are withdrawn from their supported positions on the frame members 32, and then extended through the loops 20 at the upper end of the bag 12. The tubes 30 are then mounted on the frame members 32 and held on the frame members by the hair clips 38.

Figure 5:
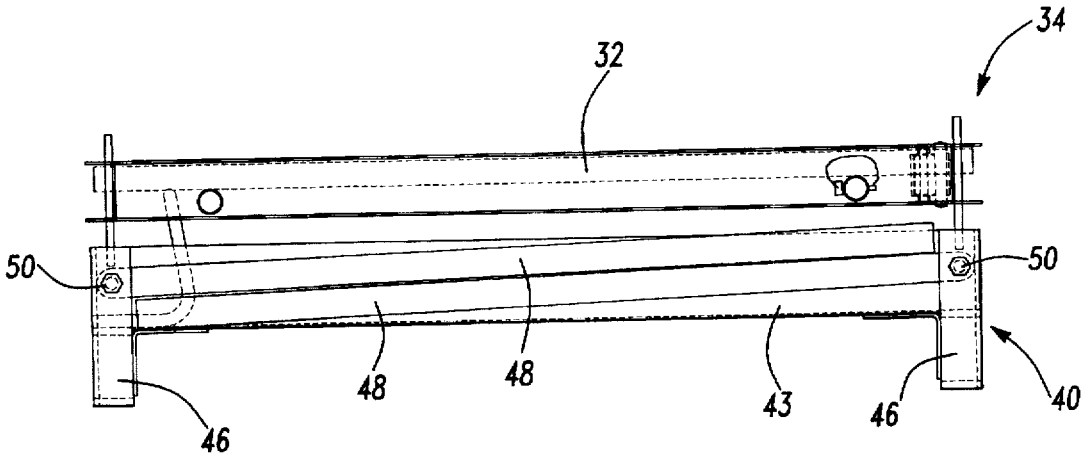
FIG. 5 is an elevational view showing the frame collapsed.
Figure 6:
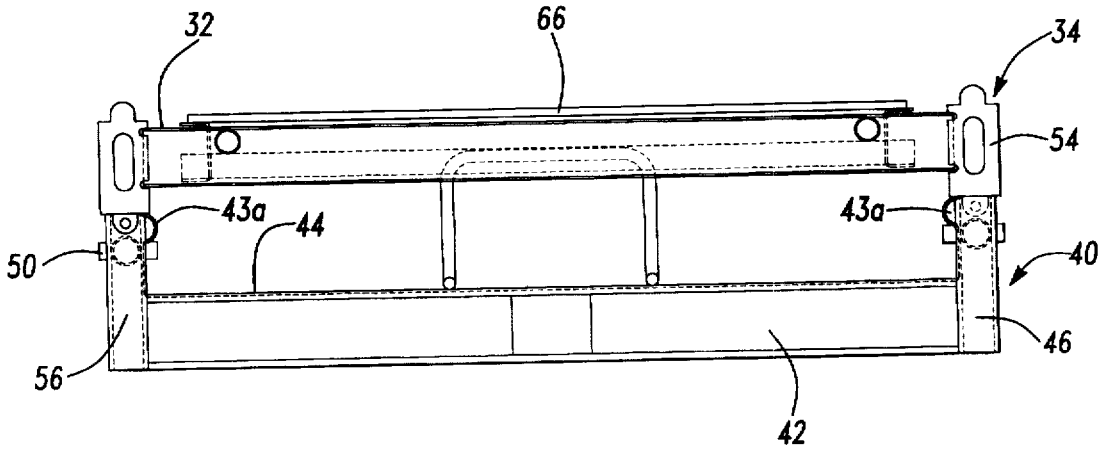
FIG. 6 is a side view of the collapsed frame.
Figure 7:
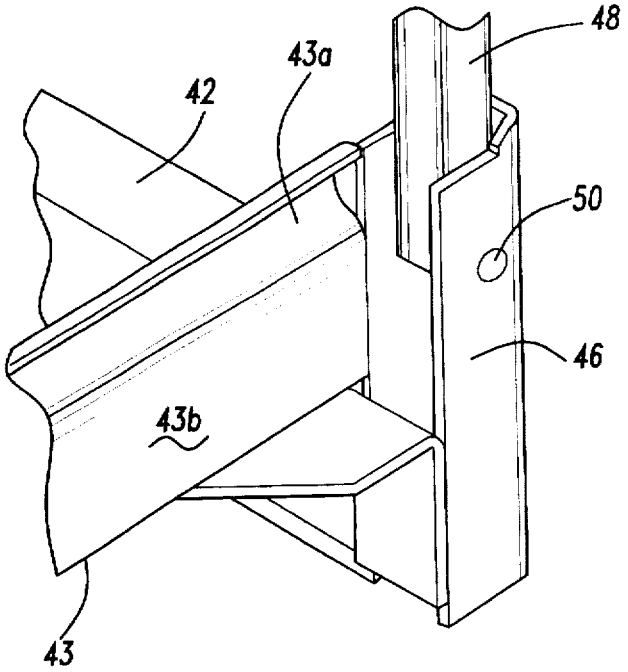
FIG. 7 is a fragmentary view of one corner of the support frame.
Figure 8:
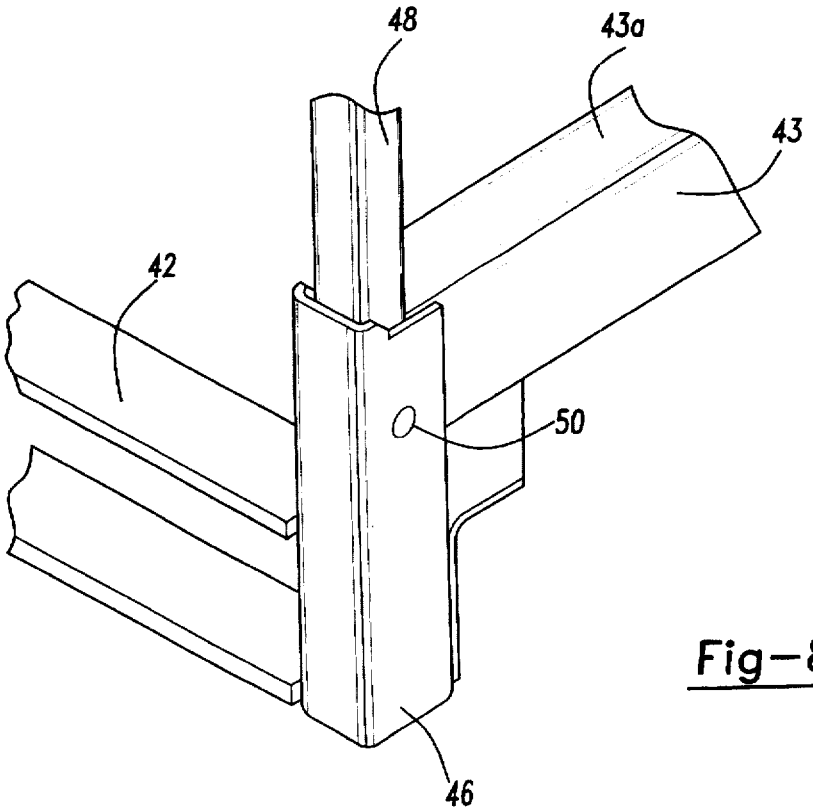
FIG. 8 is a fragmentary view like FIG. 7 showing another corner of the frame.

The upper sub-frame 34 is shown in FIGS. 5 and 6 stacked on the base 40 which is the form in which empty containers 10 are returned for re-filling. This invention minimizes the stacking height of the folded down container 10 to maximize the number that will stack in a limited space like a truck, shipping container or warehouse. This is recognized to be especially important to reduce shipping costs. The top frame 34 provides a significant improvement or a complete solution to this preexisting problem in the art by further reducing the stacking height to nearly one-half that of previous designs. The previous design would stack 7 units high in the space of a normal truck or overseas shipping container. The new improved design will stack 13 units high in that same space. This would allow for example the approximate same number of new design units to be shipped in a 20 foot shipping container as would previously have required a 40 foot shipping container.

The frame 14 consists of a base 40 which is in the form of a pallet consisting of front and rear beam members 42 and two side beam members 43. At their ends, the beams 42 and 43 are secured to upright "C" shape corner brackets 46 which also function as legs for the base 40. The side beams 43 are "P" shape, each having an arcuate top portion 43*a* extending toward the bag 12 and a planar lower portion 43*b*. The arcuate surface of each beam 43 protects the bag 12 against abrasion in case it moves from side to side during transport. The beams 43 are formed integral with plate 44 that functions as a one piece pan on which the bottom member 18 in the flexible bag 12 is supported.

Figure 4:
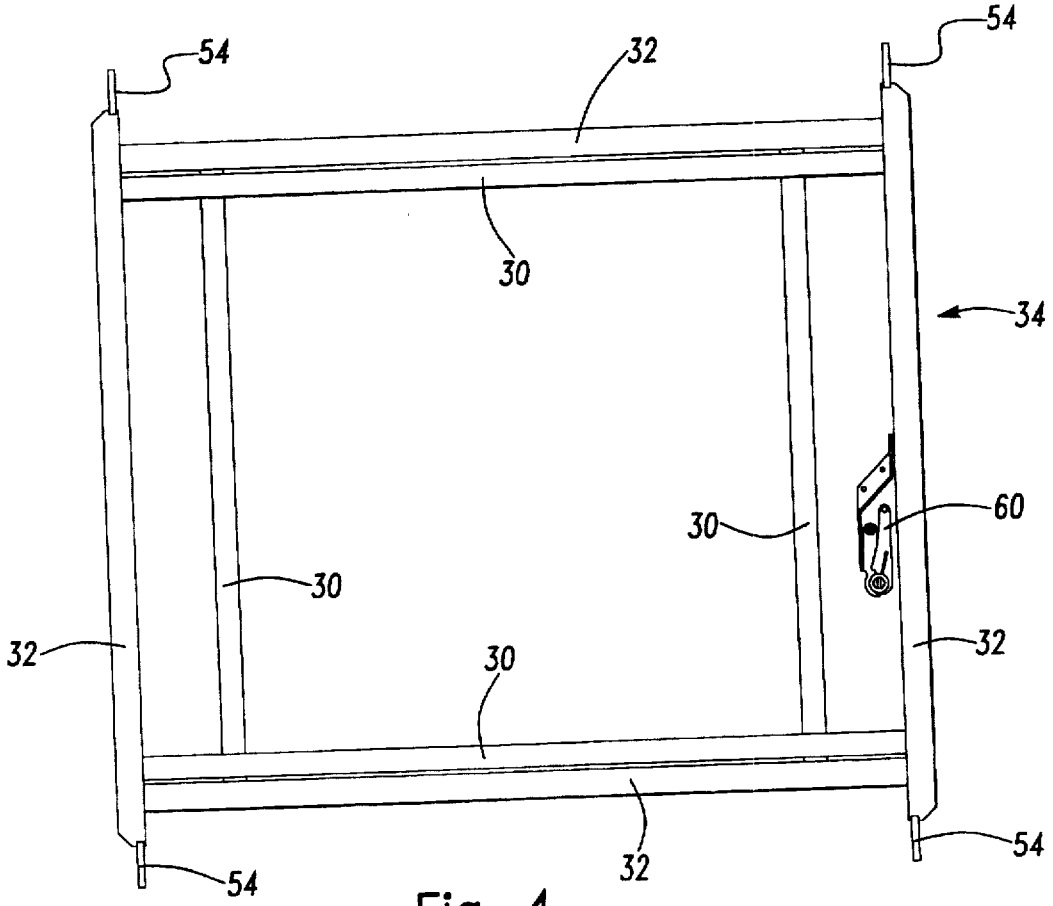
FIG. 4 is a top view of the top assembly in the rigid frame.

Upwardly extending hollow bars or support members 48 are pivotally mounted on the corner brackets 46 so that they can be pivoted about horizontal pivots 50 when the frame 14 is moved to its collapsed position shown in FIGS. 4 and 5. When the frame 14 is collapsed, the bars 48 on opposite sides of the collapsed bag 12 are arranged in generally horizontal positions on opposite sides of the bag 12.

Figure 3:
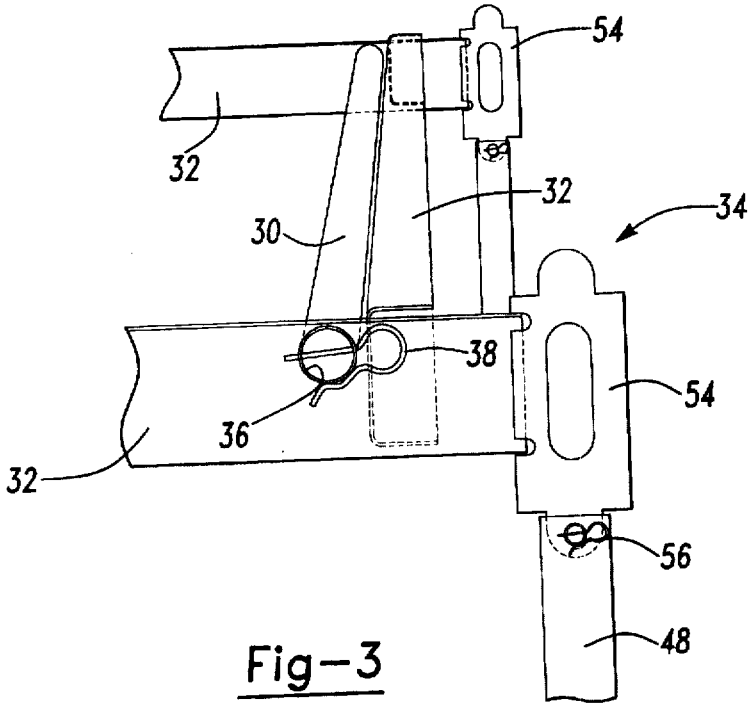
FIG. 3 is a fragmentary perspective view of details of the rigid frame.

The bars 48 are hollow so that they can removably support the upper subframe 34, as shown in FIG. 3. The subframe 34 includes corner plates or members 54 which are telescoped into the corner plates or bars 48 and retained there by pin and hair clip assemblies 56 which were previously described in connection with the mounting of the tubes 30 on the frame members 32.

In order to completely empty the bag 12, a lifting mechanism is provided for lifting the bottom member 18 in the bag upwardly to the inclined position shown in FIG. 2. The lifting mechanism comprises a rachet 60. A strap, not shown, connects the rachet 60 to a stiffening member 62 enclosed in a loop 64 at the rear end of bag bottom member 18. When the container bag 12 is nearly empty, final drainage is achieved by operating the rachet 60 so as to lift the back edge of the bag bottom member 18 upwardly so that the liquid will flow down the bag bottom member 18 through the discharge valve 24.

In the use of the container apparatus 10, the frame 14 is set up as shown in FIG. 2 and the bag is attached to the rachet 60 and to the frame 14 via the member 26. The upper ends of the bag side walls 16 are then supported on the tubular frame members 30 by inserting the frame members 30 through the loops 20 on the bag. The bag is then filled with the liquid to be stored or transported, the heavy weight of the bag contents being borne by both the tubes 30 and the plate 44. A lid 66 (FIG. 6) is then slidably mounted on the frame members 32 at the upper end of the bag 12.

It can thus be seen that by virtue of the use of the pipes 30 and the loops 20, the bag can readily be mounted on the frame 14 and conversely the bag 12 can readily be taken off the frame 14 and removed for cleaning and the like. Thus, the bag tube support system of this invention allows the customer to quickly detach the bag for cleaning or repair.

The bag bottom member 18 rests directly on the one piece plate 44 which is mounted on the front and rear beams 42 and is integral with the side beams 43. This enables the member 42 to flex and "give" in up and down directions in response to bouncing of the bag 12 on the plate 44. In other words, the plate will elastically deform under the load of the filled bag 12, but will return to its flat position when the load is reduced. Thus, the one piece plate 44 in combination with the bag tube support system enables the frame 14 to act as a shock absorber during transport and handling of the container apparatus 10. This shock absorbing action cushions the bag during transportation when the bag is filled and is carrying a heavy load, thereby reducing the prospects of bag failure.

It is to be understood that the invention is not limited to the exact construction illustrated and described above, but that various changes and modifications may be made without departing from the spirit and scope of the invention as defined in the following claims.

We claim:

1. A rigid frame supporting a deformable fabric bag for containing a flowable material to be discharged from an outlet in the lower part of the bag, characterized in that the upper portion of the bag provides a plurality of hollow sleeves, an arrangement of support tubes on said frame arranged to define an inlet for said bag, said sleeves being removably mounted on said support tubes, means forming a discharge opening in a lower part of said bag, said frame being collapsible to enable said bag to collapse, said bag further including a fabric bottom member and said frame further including a support plate on which said bag bottom member is supported, said plate being elastically deformable in response to up and down movement of said bag during transport, said tubes and said plate thereby cooperating to provide shock absorbing action to cushion said bag during transport.

2. A container assembly for transporting and storing fluid and other flowable bulk material, said assembly comprising a flexible bag having opposed side walls and an upper portion which terminates in a fill opening at the upper ends of said side walls and a rigid upright frame which terminates at its upper end in two spaced apart substantially parallel pairs of support tubes, said pairs of support tubes being arranged in mutually perpendicular fashion so as to form a rectangle, the upper ends of said side walls being provided with elongated sleeves capable of telescoping movement onto said support tubes, said rigid frame further including elongated support members and a rigid base, said support members being positioned outside the flexible bag, the elongated support members being movable from a first position in which they extend between the rigid base and said support tubes to a second position in which said support members are separated from said tubes and are in folded positions on said base to thereby allow the sides of the flexible bag to collapse thereby enabling said flexible bag to be folded into a compact position on the base with the elongated frame members being also folded on the base on opposite sides of the flexible bag, wherein said bag has a bottom member and said frame includes a support plate on which said bag bottom member rests and is supported, said plate member having edges defining a rectangular shape, and means on said frame supporting said plate only at positions near and at said edges to thereby allow up and down elastic deformable movement of said plate member, said plate member being elastically deformable in response to up and down movement of said bag during transport, said tubes and said plate thereby cooperating to provide shock absorber structure to cushion said bag during transport.

3. The structure according to claim 2 wherein said plate member is integrally formed at two of its opposing edges with upstanding beam members which are engagable with said bag to limit movement of said bag on said plate member during transport of said container assembly.

4. The structure according to claim 3 wherein each of said beam members has an arcuate surface projecting toward and engagable with said bag to prevent damage to said bag during movement on said plate.

* * * * *